US005241458A

United States Patent [19]

Abbas

[11] Patent Number: 5,241,458

[45] Date of Patent: Aug. 31, 1993

[54] METHOD AND APPARATUS FOR INSPECTING THE BARREL OF A FIREARM

[76] Inventor: Frederick M. Abbas, 1519 Salina, Dearborn, Mich. 48120

[21] Appl. No.: 842,028

[22] Filed: Feb. 25, 1992

[51] Int. Cl.[5] ..... F41G 1/34

[52] U.S. Cl. ..... 362/110; 362/111; 362/186; 362/202; 356/241

[58] Field of Search ..... 362/110, 111, 112, 186, 362/202, 206, 253, 256; 356/241; 42/103; 33/234

[56] References Cited

U.S. PATENT DOCUMENTS

| | | | |
|---|---|---|---|
| 1,057,518 | 4/1913 | Archer | 362/110 |
| 1,206,502 | 11/1916 | Bennett | 33/234 |
| 1,558,816 | 6/1926 | Sisson | 362/351 |
| 1,645,881 | 10/1927 | Strong . | |
| 1,775,452 | 9/1930 | Fisher | 356/241 |
| 1,795,401 | 3/1931 | Lawrence . | |
| 2,773,309 | 12/1956 | Elliott | 33/234 |
| 2,793,561 | 5/1957 | Jacobus | 356/241 |
| 3,245,071 | 4/1966 | Pillsbury | 362/110 |
| 3,423,154 | 1/1969 | Weber, Jr. | 356/241 |
| 3,471,945 | 10/1969 | Fleury | 35/25 |
| 4,172,274 | 10/1979 | Zemke | 362/111 |
| 4,231,077 | 10/1980 | Joyce et al. | 362/202 |
| 4,339,200 | 7/1982 | Corbin | 356/241 |
| 4,481,561 | 11/1984 | Lanning | 362/111 |
| 4,830,617 | 5/1989 | Hancox et al. | 362/111 |

FOREIGN PATENT DOCUMENTS

| | | | |
|---|---|---|---|
| 0022851 | 2/1979 | Japan | 356/241 |

OTHER PUBLICATIONS

Titan Tool Supply Company Inc., Titan Zoom-A--Bore, Jan. 1975, Sheet #470.

*Primary Examiner*—Ira S. Lazarus
*Assistant Examiner*—Y. Quach
*Attorney, Agent, or Firm*—Brooks & Kushman

[57] ABSTRACT

An inspection device for evaluating the inside surface of a barrel of a firearm is disclosed. The inspection device comprises a casing, a lightbulb and battery contained within the casing, and a light diffusion assembly. The light diffusion assembly includes an annular portion connected to one end of the casing through which light may pass, and an opaque cap portion connected to the annular portion through which light may not pass. When the inspection device is introduced into the chamber of a firearm into which ammunition is normally loaded, the lightbulb begins to burn. Light is directed by the lightbulb substantially through the annular portion of the light diffusion assembly to fall radially on the interior surface of the barrel. Visual inspection of the barrel is thereby facilitated without temporarily blinding the eyes of an observer. Also disclosed is a method using this inspection device for inspecting the barrel for residue or defects.

16 Claims, 2 Drawing Sheets

METHOD AND APPARATUS FOR INSPECTING THE BARREL OF A FIREARM

TECHNICAL FILED

This invention relates to the art of lubricating while inspecting the barrel of a firearm, and more particularly to a method and apparatus for evaluating an inside surface of the barrel with an inspection device which can be introduced into the chamber of the firearm.

BACKGROUND ART

Devices are known in the prior art which are insertable into the chamber of a firearm, and which emit a beam of light. In general, these devices are used to bore sight the firearm, or to simulate target shooting. For example, U.S. Pat. No. 4,481,561 to Lanning discloses a gun bore sighting flashlight insertable into the breach of the rifle, shotgun or pistol. The flashlight is activated upon breach closure, and aids the user in checking the sights of the firearm to assure that when the firearm is fired, the shot pattern will be directed at the same place that is visible in the sights of the gun.

U.S. Pat. No. 3,471,945 to Fleury discloses a light emitting shotgun cartridge. The shotgun cartridge consists of a cylindrical shell casing of a diameter suitable for insertion into the breach of a conventional shotgun. The cartridge employs a time delay circuit to simulate the actuatl projectile velocity, and therefore can be used to practice shooting at moving targets under field conditions.

Because the barrel of a firearm can become contaminated with rust, lead, powder residue, or other defects, it is necessary to periodically inspect the barrel. Devices such as those disclosed by Lanning and Fleury are not suitable to this task, however, since they emit a strong light down the length of the barrel that would temporarily blind an observer looking down the barrel.

SUMMARY OF THE INVENTION

Accordingly, it is an object of the present invention to provide an inspection device for evaluating the inside surface of a barrel of a firearm which will facilitate the visual inspection of the barrel without temporarily blinding the eyes of the observer.

Another object of the present invention is to provide an inspection device of the type described above comprising a casing, light producing means contained within the casing, a battery housed within the casing, means for establishing an electrical circuit between the light producing means and the battery, and a light diffusion assembly connected to the tip of the illumination device.

Still another object of the present invention is to provide a method of inspecting an inside surface of a barrel of a firearm in which an illumination assembly and a light diffusion assembly are provided, the illumination assembly and the diffusion assembly are introduced into the chamber of the firearm, light is produced and emanates substantially radially on the interior surface of the barrel, and the inside surface of the barrel is inspected while the light falls thereon.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

With reference to the drawings, the preferred embodiments of the present invention will be described.

Figure 1:
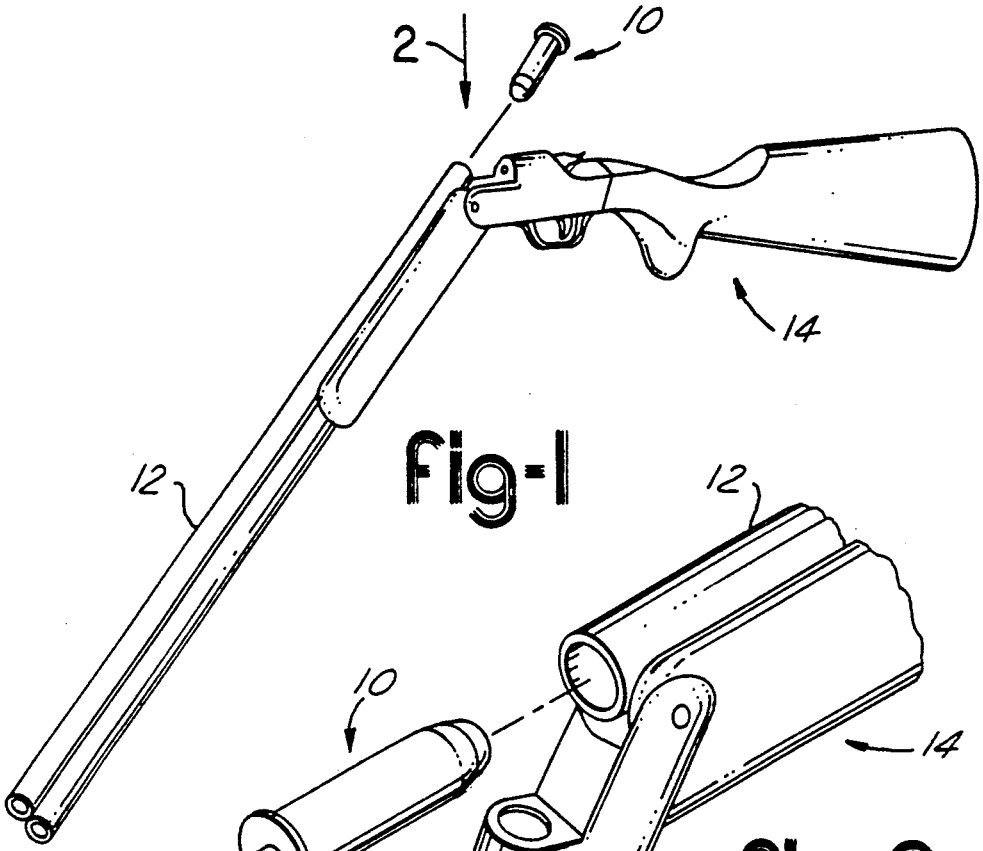
FIG. 1 is a perspective view of an inspection device according to the present invention being inserted into the chamber of a firearm.
Figure 2:
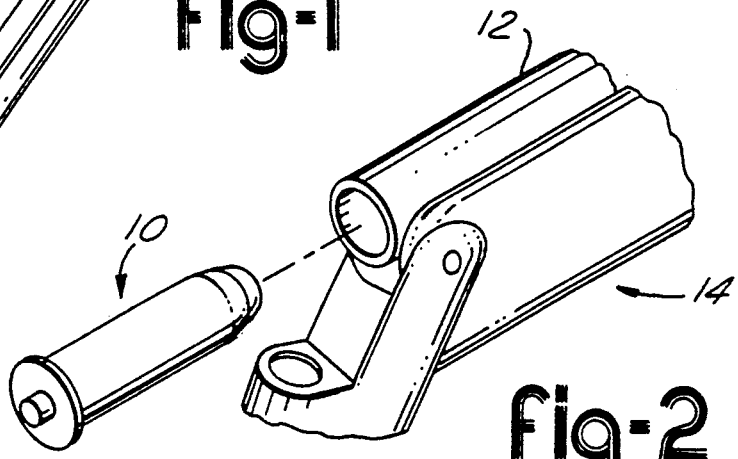
FIG. 2 is an enlarged perspective view of the inspection device being inserted into the chamber of the firearm.

FIGS. 1 and 2 show an inspection device 10 for evaluating the inside surface of a barrel 12 of a firearm 14. As can be seen, the inspection device 10 is in the shape of a shotgun shell, and is designed for insertion into the chamber of the firearm 14 into which ammunition is normally loaded.

Figure 3:
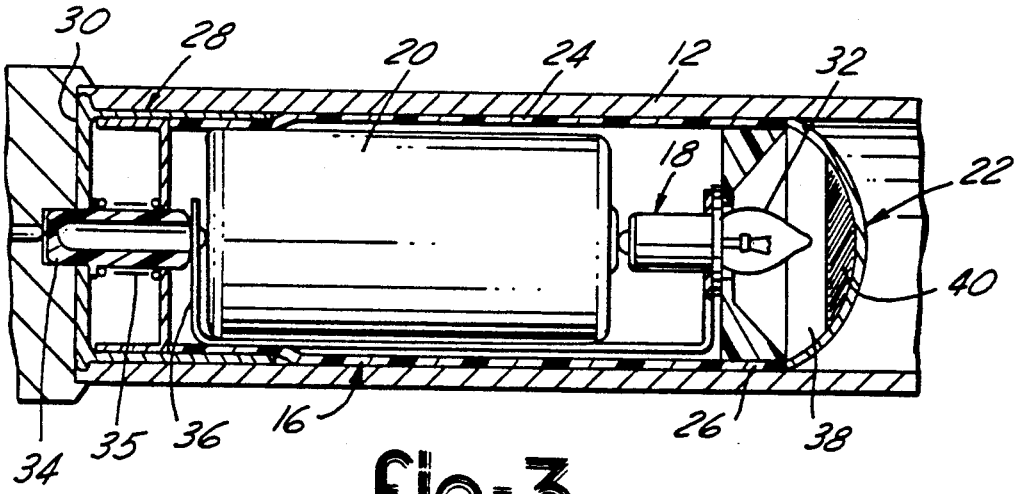
FIG. 3 is a cross-sectional view of the inspection device in the chamber of the firearm.

FIG. 3 shows that the inspection device 10 comprises a casing 16, light producing means such as lightbulb 18, a battery 20, and a light diffusion assembly 22. The casing 16 is preferably in the shape of a ten-gauge or twelve-gauge shotgun shell having a plastic main housing 24 with a first or forward end 26, and a metallic base 28 defining a second end 30 of the casing 16.

The lightbulb 18 is contained within the casing 16 such that its light emitting tip 32 extends into the concave hemisphere defined by the light diffusion assembly 22. In the preferred embodiment, the tip 32 of the lightbulb 18 is painted or otherwise tinted a reddish color to aid in diffusing the light emanating therefrom, as will be described more fully below. The main housing portion 24 of the casing 16 also includes grooves (not shown) which allow oil to pass freely around and beyond the inspection device 10 for proper lubrication cleaning.

The battery 20 is housed within the casing 16, and provides a source of electrical energy for the lightbulb 18. Means for establishing an electrical circuit between the lightbulb 18 and the battery 20 when the inspection device 10 is introduced into the chamber of the firearm are also provided in the form of an actuator 34. The actuator is normally biased by spring 35 such that it does not close electrical lead 36 against the rear of the battery 20, but is moved to the closed position shown in FIG. 3 upon being introduced into the chamber of the firearm.

The light diffusion assembly 22 includes an annular portion 38 connected to the first end 26 of the casing 16. The annular portion 38 may be either translucent or wholly transparent, but in any event, should allow light to pass readily therethrough. Connected to the annular portion 38 is an opaque cap portion 40 through which light may not readily pass.

In operation, the inspection device 10 is introduced into the chamber where ammunition is normally loaded for firing. As the chamber of the firearm closes, the actuator 34 is biased to close the connection between the electrical lead 36 and the battery 20. This completes a circuit, which activates the lightbulb 18. Light is then directed by the lightbulb 18 from the first end 26 of the casing 16, and emanates substantially through the annular portion 38 of the light diffusion assembly 22 to fall radially on the interior surface of the barrel 12. Because the inspection device 10 provides non-glare illumination on the interior surface of the barrel, visual inspection of the barrel is thereby facilitated without temporarily blinding the keys of the observer. When the inspection process is complete, the inspection device can be ejected in the same manner as any other shell, and the inspection device 10 will turn itself off.

Figure 4:
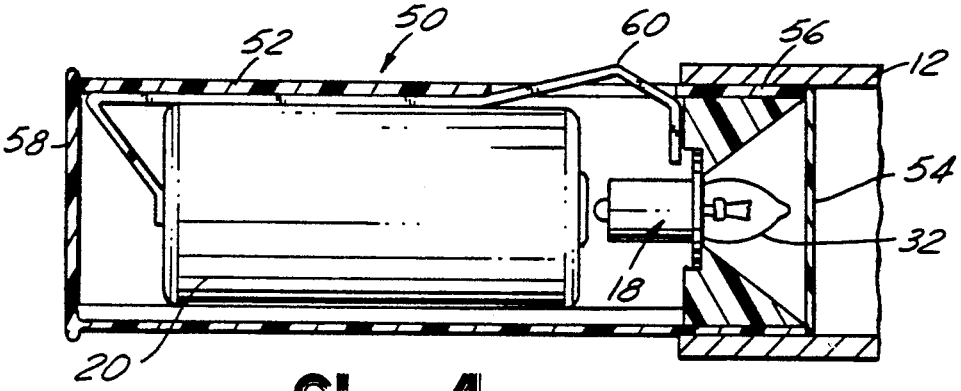
FIG. 4 is a cross-sectional view of a second embodiment of the inspection device just prior to insertion in the chamber.
Figure 5:
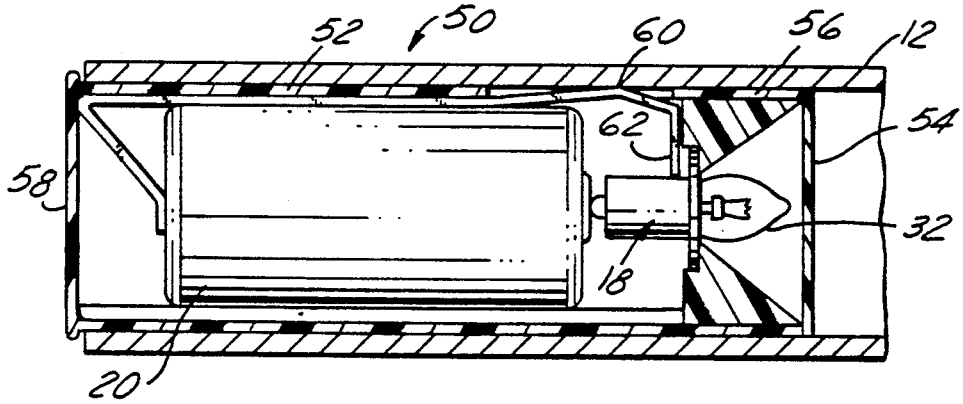
FIG. 5 is a cross-sectional view of the embodiment shown in FIG. 4 after insertion into the chamber.

FIGS. 4 and 5 show an alternative embodiment of the inspection device 50 according to the present invention. The casing 52 is generally the same shape as the embodiment shown in FIGS. 1-3, but is not provided with a metallic base. A modified light diffusion assembly 54 extends across the first end 56 of the casing 52, infernally perpendicular thereto. The light diffusion assembly 54 in this embodiment merges the functions of the annular portion and the cap portion into a single darkened, translucent piece. The tip 32 of lightbulb 18 is positioned in the forward end of the casing 52 proximate the light diffusion assembly 54. In place of an actuator at the second end 58 of the casing 52, a switch pin 60 is provided. The switch pin 60 normally extends outside the circumference of the cylindrical casing 52, but is closable when the inspection device 50 is introduced into the chamber of the firearm. As shown in FIG. 5, when the switch pin 60 is depressed, contact is made between the lightbulb 18 and an extension 62 of the switch in 60, and the battery 20 is pushed forward until it meets the rear of the lightbulb 18. The electrical circuit is thereby completed.

Figure 6:
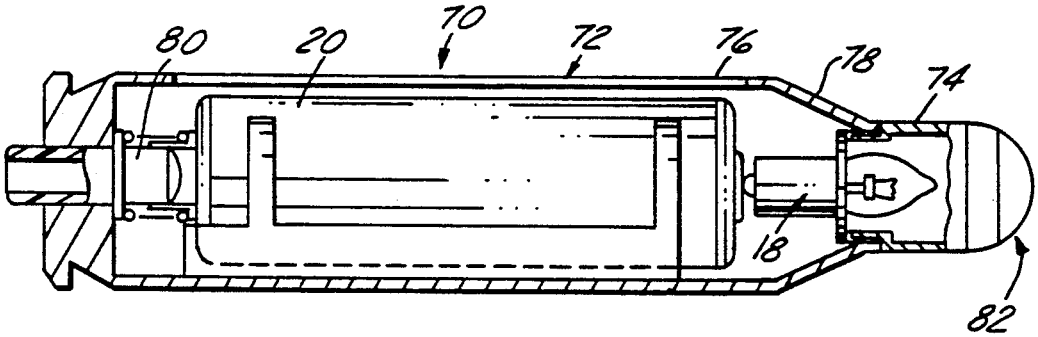
FIG. 6 is a cross-sectional view of a third embodiment of the inspection device.

While the embodiments shown in FIGS. 1-5 are shaped like a shotgun shell, it should be understood that the inspection device 10 can be adapted for use in other firearms such as rifles or pistols. FIG. 6, for example, shows another alternative embodiment of the inspection device 70 shaped like a bullet. The casing 72 of this embodiment comprises a first cylindrical portion 74, a second cylindrical portion 76, and a tapering neck 78 connecting the first and second cylindrical portions. The diameter of the first cylindrical portion 74 is smaller than the diameter of the second cylindrical portion 76. This embodiment functions similarly to the embodiment shown in FIGS. 1-3, as an actuator 80 on the rear of the casing 72 is biased to close an electrical circuit upon being introduced into the chamber. Light then shines from the lightbulb 18, radially out the light diffusion assembly 82, and onto the inside surface of the bore of the firearm.

From the above descriptions, a method of inspecting an inside surface of a barrel of a firearm is apparent. Initially, an illumination assembly is provided including a casing having a first end and a second end. The illumination assembly also has light producing means contained within the casing for directing light from the first end of the casing, a battery housed within the casing, and means for establishing an electrical circuit between the light producing means and the battery when the illumination assembly is introduced into the chamber of the firearm.

A light diffusion assembly is then provided on the illumination assembly. The light diffusion assembly includes an annular portion connected to the first end of the illumination assembly through which light may pass, and a cap portion connected to the annular portion through which light may not pass.

Next, the illumination assembly and the light diffusion assembly are introduced into the chamber of the firearm. The electrical circuit between the light producing means and the battery is thus established, and light is directed by the lightbulb from the first end of the casing. The light emanates substantially through the annular portion of the light diffusion assembly to fall radially on the interior surface of the barrel.

Finally, the inside surface of the barrel can be inspected for residue or defects while the light falls thereon.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

What is claimed is:

1. A method of inspecting an inside surface of a barel of a firearm, the firearm having a chamber into which ammunition is normally loaded, the method comprising:

providing an illumination assembly including a casing having a first end and a second end, the illumination assembly having light producing means contained within the casing for directing light from the first end of the casing, a battery housed within the casing, and means for establishing an electrical circuit between the light producing means and the battery when the illumination assembly is introduced into the chamber of the firearm;

providing a light diffusion assembly on the illumination assembly, the light diffusion assembly including an annular potion connected to the first end of the illumination assembly through which light may pass, and a cap portion connected to the annular portion through which light may not pass;

introducing the illumination assembly and the light diffusion assembly into the chamber of the firearm, whereby the electrical circuit between the light producing means and the battery is established, light being directed by the light producing means from the first end of the casing, the light emanating substantially through the annular portion of the light diffusion assembly to fall radially on the inside surface of the barrel so that any eye of an observer is not blinded thereby; and inspecting the inside surface of the barrel while the light falls thereon.

2. The method of claim 1 wherein the annular portion of the light diffusion assembly is transparent.

3. The method of claim 1 wherein the annular portion of the light diffusion assembly is translucent.

4. The method of claim 1 wherein the cap portion of the light diffusion assembly is opaque.

5. The method of claim 1 wherein the means for establishing an electrical circuit between the light producing means and the battery comprises a switch disposed on the second end of the casing which is closed when the illumination assembly and the light diffusion assembly are introduced into the chamber of the firearm.

6. The method of claim 1 wherein the casing is generally cylindrical, and the means for establishing an electrical circuit between the light producing means and the battery comprises a switch which is extendable outside the circumference of the casing, the switch being closable when the illumination assembly and the light diffusion assembly are introduced into the chamber of the firearm.

7. The method of claim i wherein the step of inspecting the barrel is performed visually.

8. An inspection device for evaluating an inside surface of a barrel of a firearm, the firearm having a chamber into which ammunition is normally loaded, the inspection device comprising:

a casing having a first end and a second end;

light producing means contained within the casing for directing light from the first end of the casing;

a battery housed within the casing;

means for establishing an electrical circuit between the light producing means and the battery when the inspection device is introduced into the chamber of the firearm; and a light diffusion assembly including an annular portion connected to the first end of the casing through which light may pass, and an opaque cap portion connected to the annular portion through which light may not pass;

whereby when the inspection device is introduced into the chamber of the firearm, the electrical circuit between the light producing means and the battery is established, light being directed by the light producing means from the first end of the casing, the light emanating substantially through the annular portion of the light diffusion assembly to fall radially on the inside surface of the barrel, thereby facilitating visual inspection of the barrel without blinding an eye of an observer.

9. The inspection device of claim 8 wherein the casing comprises a first cylindrical portion having a first diameter, a second cylindrical portion having a second diameter, the first diameter being less than the second diameter, and a tapering neck portion connecting the first and second cylindrical portions.

10. A method of inspecting and lubricating an inside surface of a barrel of a firearm, the firearm having a chamber into which ammunition is normally loaded, the method comprising:

providing an illumination assembly including a casing having a first end and a second end, the illumination assembly having light producing means contained within the casing for direction light form the first end of the casing, a battery housed within the casing, and means or establishing an electrical circuit between the light producing means and the battery when the illumination assembly is introduced into the chamber of the firearm;

providing a light diffusion assembly on the illumination assembly, the light diffusion assembly including an angular portion connected that first end of the illumination assembly through which light may pass, and a cap portion connected to the annular portion through which light may not pass;

introducing the illumination assembly and the light diffusion assembly into the chamber of the firearm, whereby the electrical circuit between the light producing means and the battery is established, light being directed by the light producing means form the first end of the casing, the light emanating substantially through the annular portion of the light diffusion assembly to fall radially on the inside surface of the barel so that an eye of an observer is not blinked thereby;

inspecting the inside surface of the barrel while the light falls thereon; and lubricating the inside surface of the barel while the illuminating assembly is positioned within the chamber.

11. The method of claim 10 wherein the annular portion of the light diffusion assembly is transparent.

12. The method of claim 10 wherein the annular portion of the light diffusion assembly is translucent.

13. The method of claim 10 wherein the cap portion of the light diffusion assembly is opaque.

14. The method of claim 10 wherein the means for establishing an electrical circuit between the light producing means and the battery comprises a switch disposed on the second end of the casing which is closed when the illumination assembly and the light diffusion assembly are introduced into the chamber of the firearm.

15. The method of claim 10 wherein the casing is generally cylindrical, and the means for establishing an electrical circuit between the light producing means and the battery comprises a switch which is extendable outside the circumference of the casing, the switch being closable when the illumination assembly and the light diffusion assembly are introduced into the chamber of the firearm.

16. The method of claim 10 wherein the step of inspecting the barrel is performed visually.

* * * * *